US010301970B2

(12) United States Patent
Fukushima et al.

(10) Patent No.: US 10,301,970 B2
(45) Date of Patent: May 28, 2019

(54) AXIAL TURBINE

(71) Applicant: Mitsubishi Hitachi Power Systems, Ltd., Nishi-ku, Yokohama (JP)

(72) Inventors: Hisataka Fukushima, Yokohama (JP); Takeshi Kudo, Yokohama (JP); Shigeki Senoo, Yokohama (JP); Hideki Ono, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 340 days.

(21) Appl. No.: 15/182,707

(22) Filed: Jun. 15, 2016

(65) Prior Publication Data

US 2016/0369654 A1 Dec. 22, 2016

(30) Foreign Application Priority Data

Jun. 18, 2015 (JP) ..... 2015-122895

(51) Int. Cl.
*F01D 25/24* (2006.01)
*F01D 5/14* (2006.01)
(Continued)

(52) U.S. Cl.
CPC ..... *F01D 25/24* (2013.01); *F01D 5/12* (2013.01); *F01D 5/145* (2013.01); *F01D 5/225* (2013.01);
(Continued)

(58) Field of Classification Search
CPC ..... F01D 25/24; F01D 5/225; F01D 5/145; F01D 9/04; F05D 2240/11;
(Continued)

(56) References Cited

U.S. PATENT DOCUMENTS 8,425,181 B2 4/2013 Senoo
2010/0226768 A1* 9/2010 Senoo ..... F01D 5/143 415/208.1
2016/0063139 A1* 3/2016 Cellier ..... F01D 5/14 703/1

FOREIGN PATENT DOCUMENTS

EP 2 226 471 A2 9/2010
EP 2 853 694 A2 4/2015
(Continued)

OTHER PUBLICATIONS

Extended European Search Report issued in counterpart European Application No. 16174782.9 dated Nov. 18, 2016 (Seven (7) pages).

*Primary Examiner* — Carlos A Rivera
*Assistant Examiner* — Danielle M. Christensen
(74) *Attorney, Agent, or Firm* — Crowell & Moring LLP

(57) ABSTRACT

An axial turbine includes an upstream turbine stage that includes: a cover disposed at a distal end of an upstream bucket and opposed to an inner wall of an upstream diaphragm outer ring across a gap; and a downstream diaphragm outer ring that is disposed downstream of the upstream turbine stage and that has an inner peripheral-side end wall shaped into a flare. The inner peripheral-side end wall of the downstream diaphragm outer ring has a flare angle formed to be greater than a slant angle of an inner peripheral-side wall of the cover. In the axial turbine, the inner peripheral-side end wall of the downstream diaphragm outer ring is formed to have a meridional shape that has at least one inflection point between the upstream turbine stage and a downstream turbine stage and such that a tangent at the inflection point with respect to a steam flow direction has a positive gradient.

3 Claims, 10 Drawing Sheets

(51) Int. Cl.
*F01D 5/22* (2006.01)
*F01D 5/12* (2006.01)
*F01D 9/04* (2006.01)

(52) U.S. Cl.
CPC ..... *F01D 9/041* (2013.01); *F05D 2220/30* (2013.01); *F05D 2220/31* (2013.01)

(58) Field of Classification Search
CPC ..... F05D 2240/14; F05D 2250/184; F05D 2250/71; F05D 2250/711
See application file for complete search history.

(56) References Cited

FOREIGN PATENT DOCUMENTS

| | | | |
|---|---|---|---|
| JP | 59-90704 | A | 5/1984 |
| JP | 61-275504 | A | 12/1986 |
| JP | 3-189304 | A | 8/1991 |
| JP | 10-238307 | A | 9/1998 |
| JP | 2010-203302 | A | 9/2010 |
| JP | 2013-148059 | A | 8/2013 |

* cited by examiner

AXIAL TURBINE

BACKGROUND OF THE INVENTION

1. Field of the Invention

The present invention relates to an axial turbine.

2. Description of Related Art

Gas turbines and steam turbines used in, for example, power plants are broadly classified into the following three types: an axial turbine, a diagonal turbine, and a radial turbine according to the direction in which a working fluid flows. The working fluid flows: in a direction along a rotational axis of a turbine in the axial turbine; in a direction diagonally expanding from the rotational axis of the turbine in the diagonal turbine; and in a radial direction with respect to the rotational axis of the turbine in the radial turbine. Of these three types of turbines, the axial turbine is particularly suitable for power plants having medium to large capacities and is widely applied to steam turbines in large-scale thermal power stations.

Recent growing interest in improved economy and reduced environment load has prompted a need for even greater power generation efficiency in power plants. Providing turbines with enhanced functions is thus an important issue to be addressed. Factors that govern turbine performance include stage loss, exhaust loss, and mechanical loss. It is considered to be effective to have a greater annulus area, specifically, to increase a blade height or a pitch circle diameter to thereby increase kinetic energy of the working fluid recovered in a last stage and to thus reduce the exhaust loss.

Increasing the annulus area, however, involves the following problems: (1) increased stress acting on a bucket and a rotor; (2) a stronger likelihood that loss will increase because of an inlet velocity becoming supersonic on a bucket tip side; (3) a stronger likelihood that separation will occur at an enlarged passage portion on an outer peripheral side; and (4) a stronger likelihood that an erosion amount will increase caused by droplets on the bucket tip side. Of the foregoing four problems, the problem of (3) "a stronger likelihood that separation will occur at an enlarged passage portion on an outer peripheral side" is extremely critical, because the problem not only constitutes a factor for occurrence of loss, but also can affect a flow pattern in a turbine stage disposed downstream of the separation.

As a solution, to the foregoing problem, a technique has been developed in which an annular baffle plate that follows a profile of a diaphragm outer ring is disposed between the diaphragm outer ring and a diaphragm inner ring in the turbine stage of the last stage (see, for example, JP-2013-148059-A). The technique causes the annular baffle plate to form an annular passage, thereby allegedly preventing occurrence of a separation and a reverse flow at an enlarged passage portion on an outer peripheral side.

SUMMARY OF THE INVENTION

A separation occurring at the enlarged passage portion on the outer peripheral side, specifically, on an inner peripheral-side end wall of the diaphragm outer ring induces an excessively large radial velocity component at a nozzle disposed downstream of the separation. As a result, in an inlet flow into a bucket disposed downstream of the nozzle, an unintentional change in outlet flow angle can occur.

Another known technique for preventing the separation includes, inside the nozzle, an inner peripheral-side end wall of the diaphragm outer ring having a meridional shape curved into an S-shape. Nonetheless, the configuration still induces an excessively large radial velocity component at the nozzle, so that a problem similar to the problem involved in the occurrence of the separation can occur.

JP-2013-148059-A fails to disclose an effect caused by the separation and the meridional shape of the inner peripheral-side end wall of the diaphragm outer ring on the flow pattern in a downstream stage. Even if the separation can be prevented, therefore, a likelihood remains that incidental loss may occur as a result of a change in the flow pattern in the downstream turbine stage. Thus, a sufficient efficiency improving effect may not be achieved by the technique disclosed in JP-2013-148059-A.

The present invention has been made in view of the foregoing situation and it is an object of the present invention to provide a high efficiency and high performance axial turbine capable of preventing separation from occurring on an inner peripheral side end wall of a diaphragm outer ring without affecting a flow pattern in a downstream turbine stage.

To achieve the foregoing object, the present invention adopts configurations as defined, for example, in the appended claims. The present application includes a plurality of means for solving the foregoing problems. In one aspect, the present invention provides an axial turbine that includes an upstream turbine stage and a downstream turbine stage. The upstream turbine stage includes: a plurality of upstream nozzles arrayed in a tangential direction between an upstream diaphragm outer ring and an upstream diaphragm inner ring; a plurality of upstream buckets disposed on an outer peripheral side of a turbine rotor and arrayed in the tangential direction; and a cover disposed at a distal end of the upstream bucket in such a manner that it is opposed to an inner wall of the upstream diaphragm outer ring across a gap. The downstream turbine stage includes: a downstream diaphragm outer ring disposed downstream of the upstream turbine stage, the downstream diaphragm outer ring having an inner peripheral-side end wall shaped into a flare; a plurality of downstream nozzles arrayed in the tangential direction between the downstream diaphragm outer ring and a downstream diaphragm inner ring; and a plurality of downstream buckets disposed on the outer peripheral side of the turbine rotor and arrayed in the tangential direction. The inner peripheral-side end wall of the downstream diaphragm outer ring has a flare angle formed to be greater than a slant angle of an inner peripheral-side wall of the cover. In this axial turbine, the inner peripheral-side end wall of the downstream diaphragm outer ring is formed to have a meridional shape that has at least one inflection point between the upstream turbine stage and the downstream turbine stage and such that a tangent at the inflection point with respect to a steam flow direction has a positive gradient.

In one aspect, the present invention can provide a high efficiency and high performance axial turbine capable of preventing separation from occurring on an inner peripheral-side end wall of a diaphragm outer ring without affecting a flow pattern in a downstream turbine stage.

BRIEF DESCRIPTION OF THE DRAWINGS

The present invention will be described hereinafter with reference to the accompanying drawings.

DETAILED DESCRIPTION OF THE PREFERRED EMBODIMENTS

Figure 1:
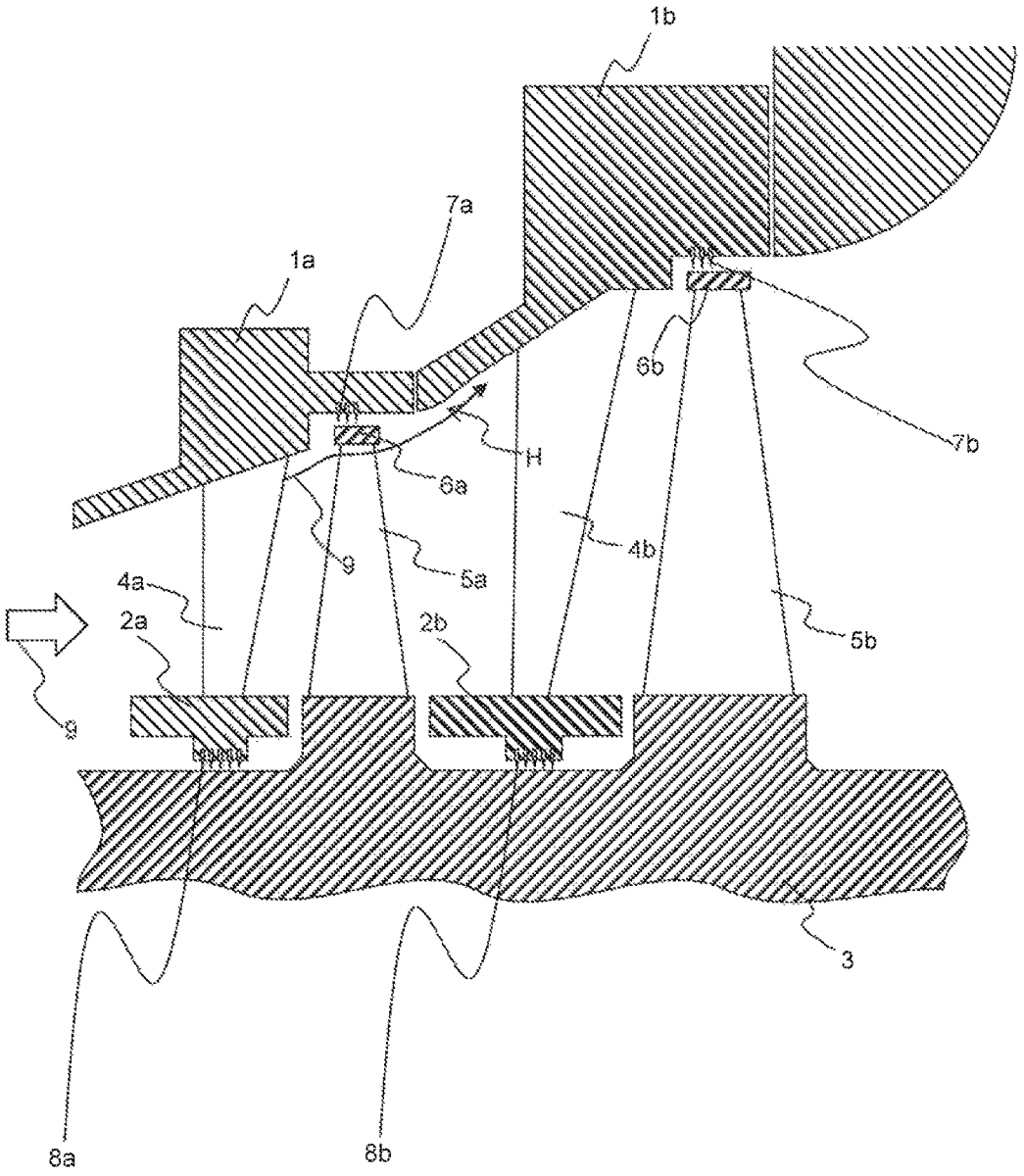
FIG. 1 is a cross-sectional view of part of meridional cross-section in a vertical direction of a steam turbine as an axial turbine according to a first embodiment of the present invention.

The following describes, with reference to the accompanying drawings, embodiments of an axial turbine according to the present invention.

Throughout the drawings, like or corresponding elements are identified by like reference numerals. For convenience sake, each reference numeral is appended with a suffix "a" to denote an element in an upstream turbine stage and with a suffix "b" to denote an element in a downstream turbine stage. Additionally, each of the embodiments to be described hereunder represents the present invention applied to a low pressure stage of a steam turbine. Similar effects of the present invention can nonetheless be achieved in a high-to-intermediate pressure stage of a steam turbine and a gas turbine using a different type of working fluid, thus the present invention can be applied to axial turbines in general. Additionally, for an easier understanding of a configuration of each of the embodiments according to the present invention, part of dimensions of the drawings may be emphatically indicated.

First Embodiment

FIG. 1 is a cross-sectional view of part of a meridional cross-section in a vertical direction of a steam turbine as an axial turbine according to a first embodiment of the present invention.

As illustrated in FIG. 1, a turbine stage of the steam turbine according to the first embodiment includes a turbine rotor 3, buckets 5*a* and 5*b*, diaphragm outer rings 1*a* and 1*b*, diaphragm inner rings 2*a* and 2*b*, and nozzles 4*a* and 4*b*. Specifically, the turbine rotor 3 is rotatably supported. One or a plurality of buckets 5*a* and 5*b* are fixed to the turbine rotor 3 in a tangential direction. The diaphragm outer rings 1*a* and 1*b* are disposed on an inner periphery of a casing not shown. The diaphragm inner rings 2*a* and 2*b* are disposed on an inside of the diaphragm outer rings 1*a* and 1*b*. One or a plurality of nozzles 4*a* and 4*b* are fixed between the diaphragm outer rings 1*a* and 1*b* and the diaphragm inner rings 2*a* and 2*b* in a turbine tangential direction.

Covers 6*a* and 6*b* are disposed at distal ends on turbine rotation radial outer peripheral sides of the buckets 5*a* and 5*b*. Outer peripheral-side radial seal fins 7*a* and 7*b* are disposed in gaps between the covers 6*a* and 6*b* and the diaphragm outer rings 1*a* and 1*b*. The radial seal fins 7*a* and 7*b* protrude from the diaphragm outer rings 1*a* and 1*b* in a radial direction of the turbine rotor 3.

In addition, inner peripheral-side radial seal fins 8*a* and 8*b* are disposed in gaps between the turbine rotor 3 and the diaphragm inner rings 2*a* and 2*b*. The radial seal fins 8*a* and 8*b* protrude from the diaphragm inner rings 2*a* and 2*b* in the radial direction of the turbine rotor 3. A plurality of the radial seal fins 7*a* and 7*b*, and a plurality of the radial seal fins 8*a* and 8*b* are disposed in a rotational axis direction of the turbine rotor 3 in order to minimize the gaps to reduce a leakage flow.

An inner peripheral-side end wall of the diaphragm outer ring 1*b* in the downstream turbine stage is configured such that a meridional shape thereof has an inflection point H between stages between the bucket ha of the upstream turbine stage and the nozzle 4*b* of the downstream turbine stage and such that a tangent at the inflection point H with respect to a steam flow direction has a positive gradient (so as to increase toward the steam flow direction).

When a steam main scream 9 into the upstream turbine stage, a good part thereof flows into the nozzle 4*a* and one part thereof flows as a diaphragm leak into a seal passage that is formed between the diaphragm inner ring 2*a* as a stationary element and the turbine rotor 3 as a rotating element.

The steam of main stream 9 that has flowed from the nozzle 4*a* loins the diaphragm leak and a good part thereof flows into the bucket 5*a*. At this time, part of the steam main stream 9 that has joined the diaphragm leak flows as a tip leakage flow into a seal passage that is formed between the diaphragm outer ring 1*a* as a stationary element and the cover 6*a*, as a rotating element.

The steam main stream 9 that has flowed from the bucket 5*a* joins the tip leakage flow and flows into the downstream turbine stage.

Figure 2:
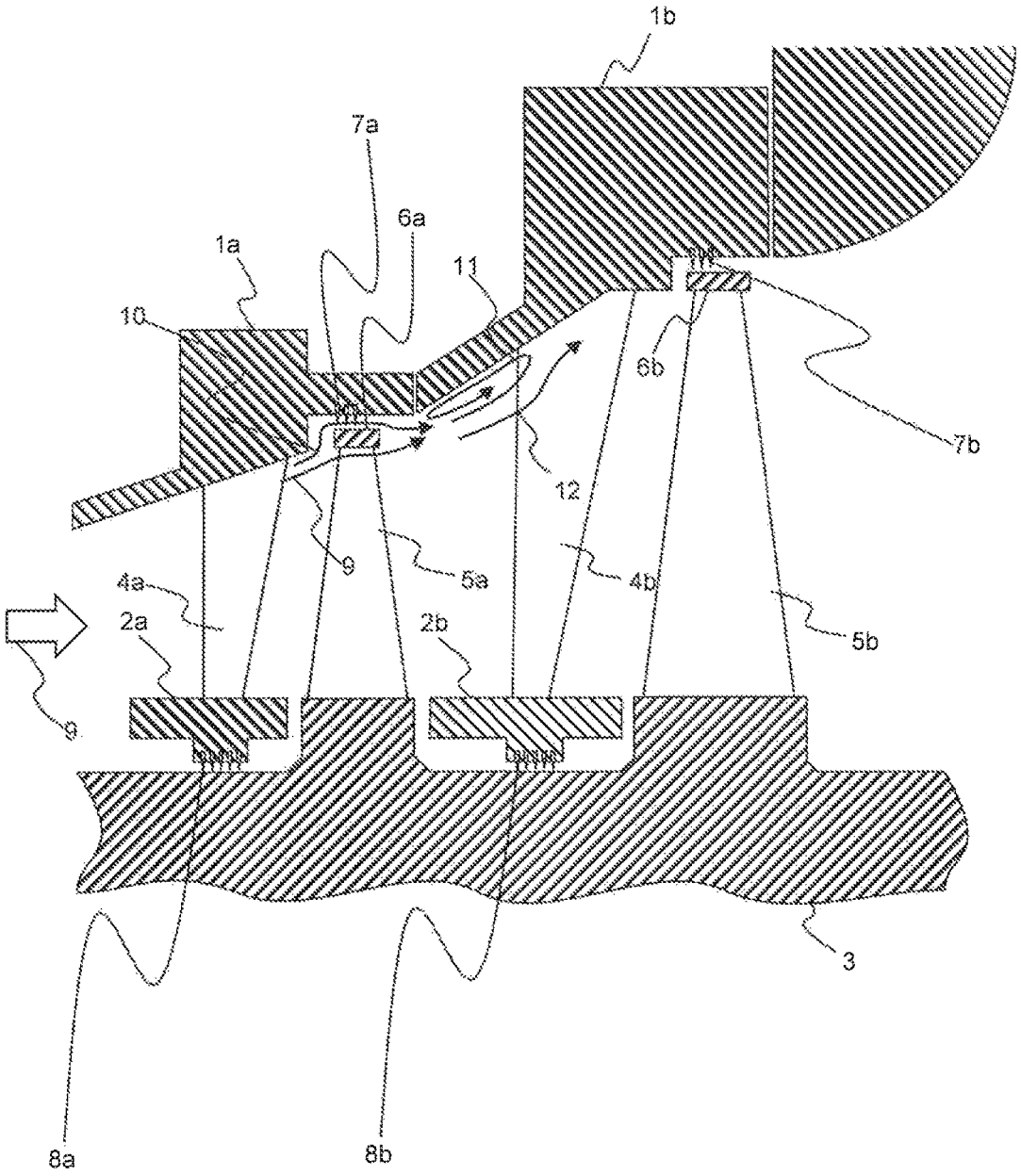
FIG. 2 is a cross-sectional view of part of a meridional cross-section in a vertical direction of a known steam turbine.

For an easier understanding of effects achieved by the present invention in the first embodiment, the following describes with reference to FIG. 2 a flow through the turbine stage in the steam turbine known in the art. FIG. 2 is a cross-sectional view of part of a meridional cross section in the vertical direction of the known steam turbine.

In FIG. 2, a steam main stream 9 that has flowed from a bucket 5*a* in an upstream turbine stare joins a tip leakage flow 10 that has bypassed a cover 6*a*, and flows into a downstream turbine stage. Because of a flare on an inner peripheral-side end wall of a diaphragm outer ring 1*b*, a passage of the downstream turbine stage is formed so as to have an increasing passage area toward a downstream side.

In this specification, an angle formed between a segment that forms the meridional cross-section of the inner peripheral-side end wall of the diaphragm outer ring 1*b* and a segment extending in a rotational axis direction will be referred to as a flare angle. Separation 11 depicted in FIG. 2 occurs when steam as a fluid is unable to follow an increase in the passage area because of a large flare angle involved in the flared passage.

In addition, the passage disposed between the bucket 5*a* in the upstream turbine stage and a nozzle 4*b* in the downstream turbine stage functions also as a diffuser, in which the steam main stream 9 recovers pressure. An adverse pressure gradient is, as a result, formed to thereby promote the separation 11. This separation 11 contributes to increased loss in the steam turbine.

Additionally, with the inner peripheral-side end wall of the diaphragm outer ring 1*b* in the downstream turbine stage, the segment that forms the meridional cross-section is typically formed linearly. As a result, a rate of change in the passage area in the most upstream side of the diaphragm outer ring 1*b* changes discontinuously in FIG. 2, the passage area remains constant over a predetermined range in the downstream of the inner peripheral-side end wall of a diaphragm outer ring 1*a* in the upstream turbine stage. The most upstream side of the diaphragm outer ring 1*b* having a flare angle is connected to the downstream of the range over which the passage area remains constant. Thus, at the point of this connection, the rate of change in the passage area changes discontinuously from zero to a constant value.

The discontinuity of the rate of change in the passage area also constitutes a factor that promotes the separation 11. Moreover, the separation 11 not only assumes a loss factor, but also induces a flow 12 that has an excessively large radial velocity component through a blockage effect of the separation 11. The flow 12 induced by the separation also affects a spanwise mass flow distribution, thus affecting a velocity triangle during a flow from the nozzle 4*b* in the downstream turbine stage.

As a result, a steam inlet flow angle with respect to the bucket 5*b* changes and incidental loss occurs including increased incidence loss. Specifically, in the known steam turbine, when a large flare angle is involved in the inner peripheral-side end wall of the diaphragm outer ring, along with an occurrence of separation, the flow pattern changes in the turbine stage disposed downstream of the separation, resulting in excessively great loss.

Figure 3:
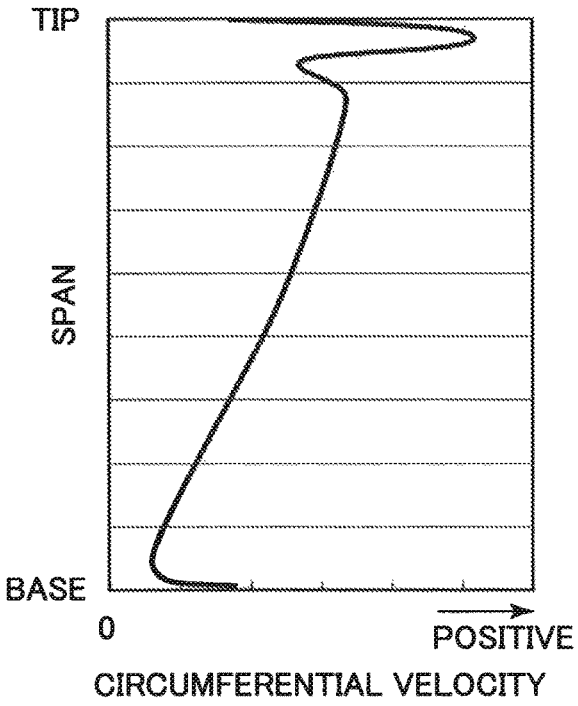
FIG. 3 is a characteristics graph depicting a spanwise circumferential velocity distribution in a downstream of a bucket in the known steam turbine.
Figure 4:
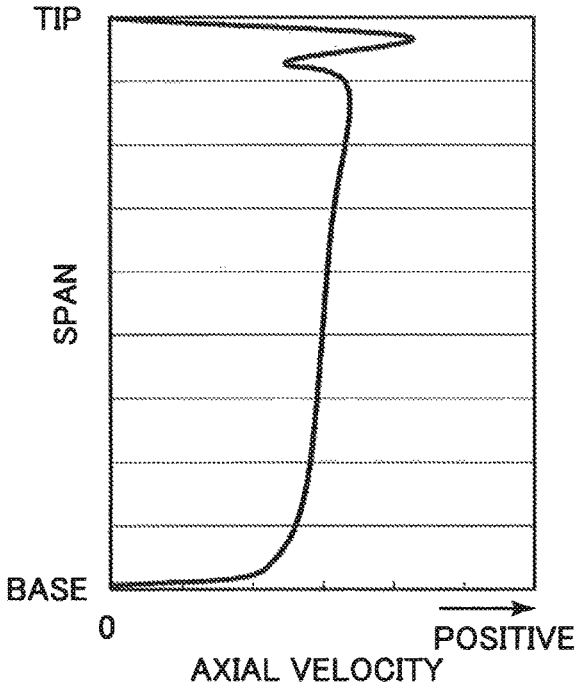
FIG. 4 is a characteristics graph depicting a spanwise axial velocity distribution in a downstream of the bucket in the known steam turbine.

The following describes, with reference to FIGS. 2 to 4, effects caused by the tip leakage flow 10 on the separation 11 that occurs on the inner peripheral-side end wall of the diaphragm outer ring. FIG. 3 is a characteristics graph depicting a spanwise circumferential velocity distribution in a downstream of a bucket in the known steam turbine. FIG. 4 is a characteristics graph depicting a spanwise axial velocity distribution in a downstream of the bucket in the known steam turbine. In FIG. 3, the abscissa represents the circumferential velocity when the bucket rotational direction is positive and the ordinate represents a span of the bucket 5*a*. In FIG. 4, the abscissa represents the axial velocity with the flow from the upstream to downstream side being defined as positive and the ordinate represents the span of the bucket 5*a*.

In FIG. 2, the tip leakage flow 10 that has bypassed the cover 6*a* does not change its direction at the bucket 5*a*, flowing downstream. Thus, the tip leakage flow 10 joins the steam main stream 9, while keeping a large circumferential velocity component.

A distribution having a large circumferential velocity is thus formed on a tip side as depicted in FIG. 3 at a position downstream of the bucket 5*a*. The circumferential velocity component of the tip leakage flow 10 causes a centrifugal force to act on the steam main stream 9, thus achieving an effect of preventing the separation 11. Additionally, the tip leakage flow 10 flows as a jet from the outer peripheral-side radial seal fin 7*a*, thus also having a large axial velocity component. A distribution having a large axial velocity is thus formed on the tip side as depicted in FIG. 4 at the position downstream of the bucket 5*a*. While the circumferential velocity component of the tip leakage flow 10 acts to prevent the separation 11, the axial velocity component acts to induce diaphragm separation. Specifically, the separation 11 can be expected to be prevented also by damping the axial velocity component.

Figure 5:
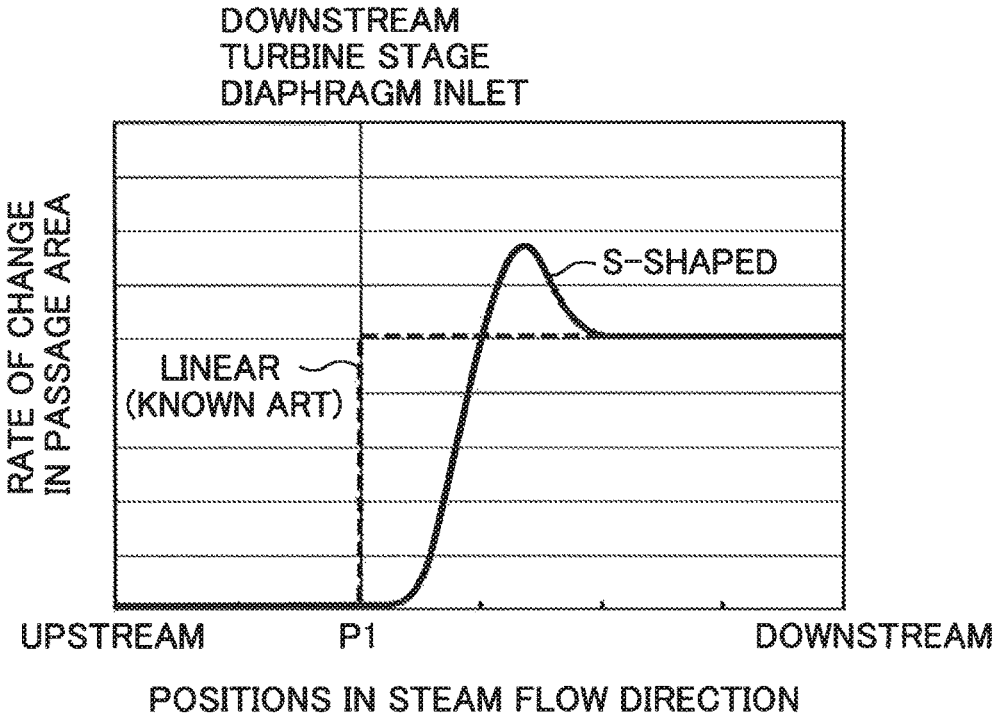
FIG. 5 is a characteristics graph depicting a rate of change in a passage area with respect to streamwise position in the axial turbine according to the first embodiment of the present invention.

The following details, with reference to FIGS. 1 and 5, configurations of and effects achieved by the first embodiment FIG. 5 is a characteristics graph depicting a rate of change in the passage area with respect to positions in the steam flow direction in the axial turbine according to the first embodiment of the present invention. In FIG. 5 the abscissa represents positions in the steam flow direction and the ordinate represents the rate of change in the passage area.

As depicted in FIG. 1, in the first embodiment, the meridional shape of the inner peripheral-side end wall of the diaphragm outer ring 1*b* in the downstream turbine stage is curved into an S-shape so as to have the inflection point H between the stages between the bucket 5*a* of the upstream turbine stage and the nozzle 4*b* of the downstream turbine stage and such that the tangent at the inflection point H with respect to the steam flow direction has a positive gradient.

Curving the meridional shape into an S-shape as described above allows the flare angle of the inner peripheral-side end wall of the diaphragm outer ring 1*b* to be brought close to a gradient of the inner peripheral-side wall of the cover 6 (which is referred to as a slant angle), while maintaining the flare angle inside the nozzle 4*b* in the downstream turbine stage. It should here be noted that, in this specification, the angle formed between a segment that forms the meridional cross-section of the inner peripheral-side wall of the cover 6 and the segment extending in the rotational axis direction is referred to as the slant angle.

Unlike the first embodiment, with the known configuration in which the inner peripheral-side end wall of the diaphragm outer ring 1*b* is formed linearly, the rate of change in the passage area at a position P1 at a diaphragm inlet in the downstream turbine stage changes discontinuously as depicted in FIG. 5. In contrast, in the first embodiment, forming the S-shaped curve enables a continuous change.

Specifically, the passage enlarges gradually also at the position near the diaphragm inlet in the downstream turbine stage, so that the steam main stream 9 can flow downstream without undergoing any separation on the end wall. In addition, forming the S-shaped curve increases the rate of change in the passage area at the position near the inflection point H; however, the position at which the rate of change takes a maximum value is shifted downstream as compared with the linearly formed meridional shape. As a result, the steam main stream 9 undergoes mixing and dissipation with a leakage flow and is decelerated by wall friction at the position near the end wall.

Additionally, the steam main stream 9, because reaching the position having a large rate of change in the passage area with a reduced axial velocity component, can follow the change in the passage area. This allows the separation to be prevented. Moreover, this prevention of the separation enables inlet, to the downstream turbine stage without inducing any excessive radial velocity component.

Thus, in the first embodiment, the separation that occurs on the inner peripheral-side end wall of the diaphragm outer ring can be prevented from occurring without the flow pattern in the downstream turbine stage being affected.

Additionally, the known steam turbine requires a certain distance between stages because the flare angle of the inner peripheral-side end wall of the diaphragm outer ring 1*b* cannot be made large in order to meet the need for preventing the separation. Curving the inner peripheral-side end wall of the diaphragm outer ring 1*b* into an S-shape, however, allows the distance between stages to be shortened without the need to change the flare angle.

Specifically, curving the inner peripheral-side end wall of the diaphragm outer ring 1*b* into an S-shape also allows the steam turbine to be shortened in the axial direction. The first embodiment has been exemplary described for the outer peripheral-side wall of the cover 6 having a flat shape. The same effect of the present invention can still be achieved even with any other shape including a stepped wall.

The first embodiment of the present invention described above can provide a high efficiency and high performance axial turbine capable of preventing separation from occurring on the inner peripheral-side end wall of the diaphragm outer ring without affecting the flow pattern in the downstream turbine stage.

Second Embodiment

Figure 6:
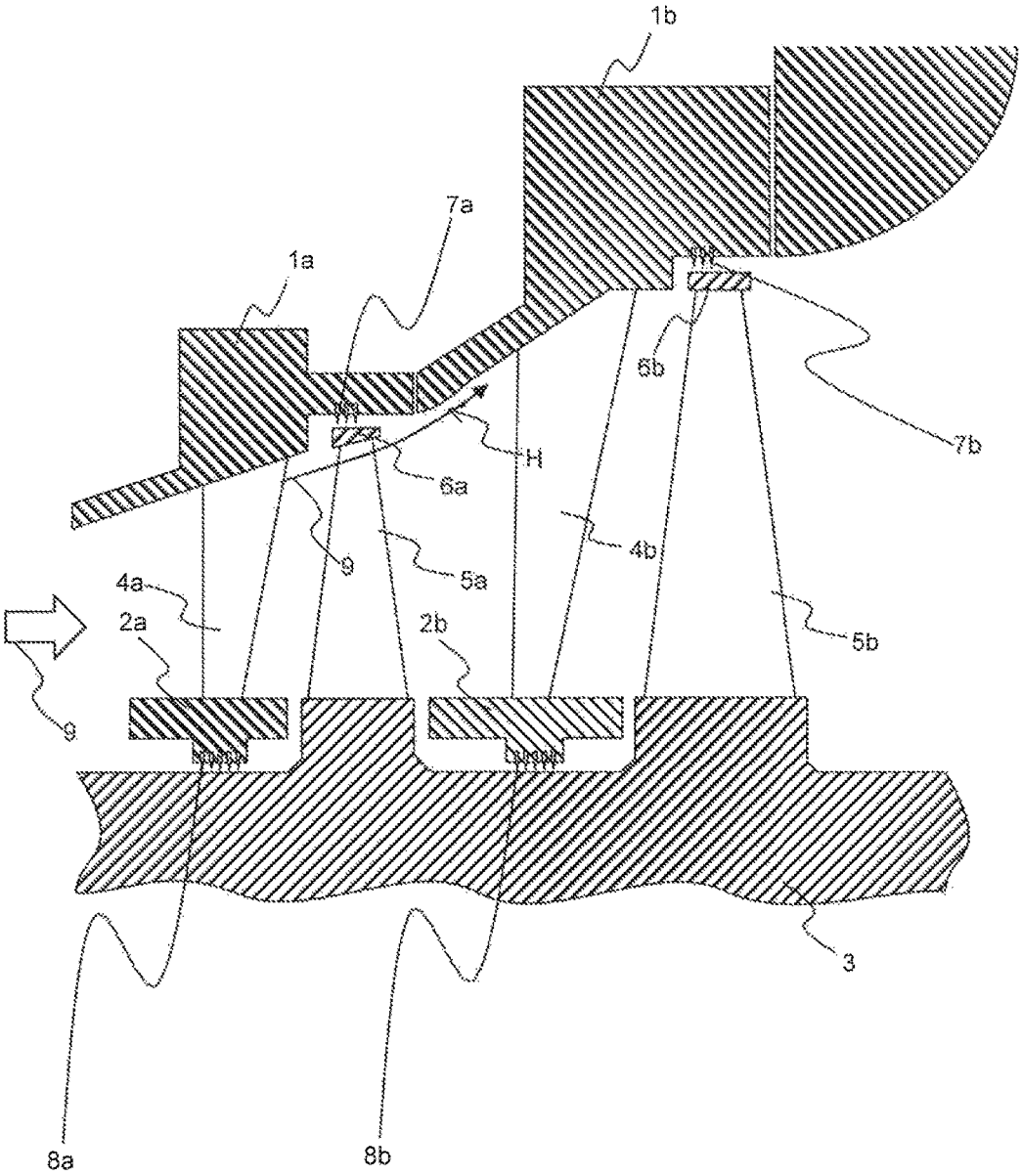
FIG. 6 is a cross-sectional view of part of a meridional cross-section in the vertical direction of a steam turbine as an axial turbine according to a second embodiment of the present invention.
Figure 7:
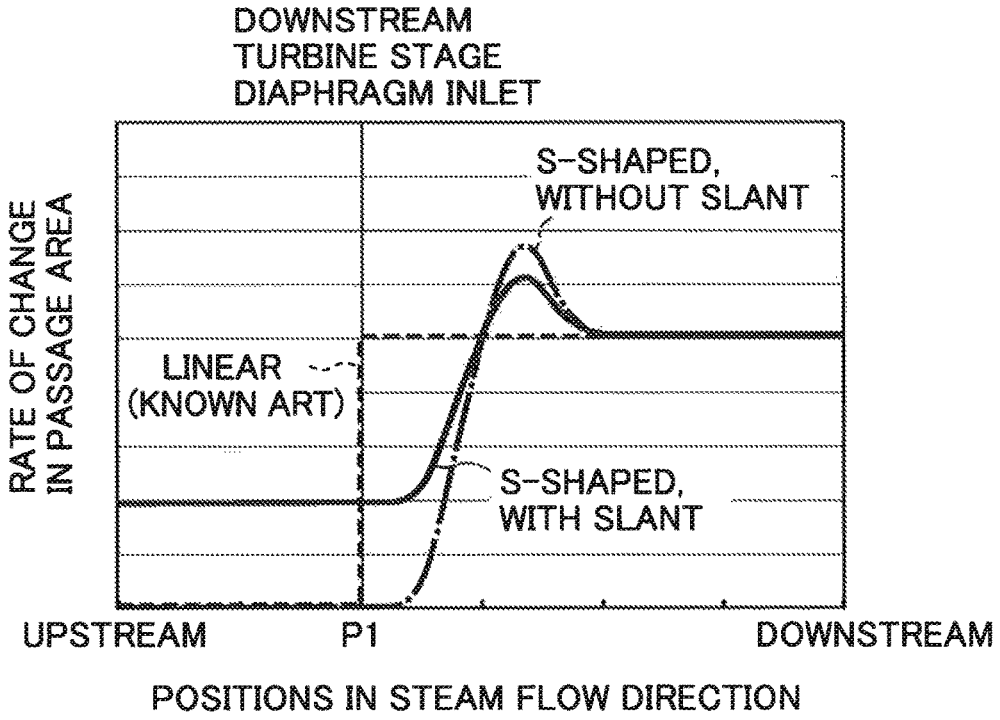
FIG. 7 is a characteristics graph depicting the rate of change in the passage area with respect to positions in the steam flow direction in the axial turbine according to the second embodiment of the present invention.
Figure 8:
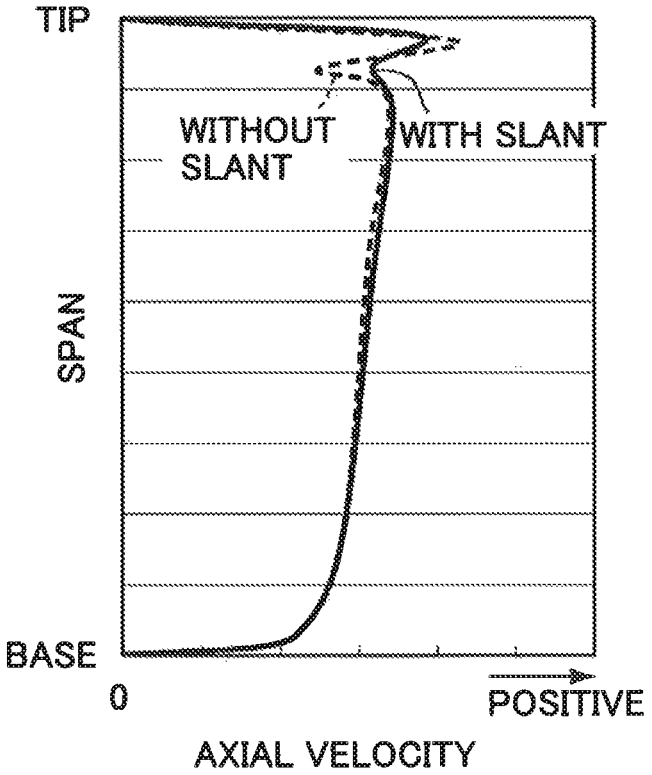
FIG. 8 is a characteristics graph depicting a spanwise axial velocity distribution in a downstream of a bucket in the steam turbine as the axial turbine according to the second embodiment of the present invention.

The following describes, with reference to the relevant accompanying drawings, an axial turbine according to a second embodiment of the present invention. FIG. 6 is a cross-sectional view of part of a meridional cross-section in the vertical direction of a steam turbine as the axial turbine according to the second embodiment of the present invention. FIG. 7 is a characteristics graph depicting the rate of change in the passage area with respect to positions in the steam flow direction in the axial turbine according to the second embodiment of the present invention. FIG. 8 is a characteristics graph depicting a spanwise axial velocity distribution in a downstream of a bucket in the steam turbine as the axial turbine according to the second embodiment of the present invention. In FIGS. 6 to 8, like reference numerals as those used in FIGS. 1 to 5 denote like or corresponding parts and descriptions for those parts will be omitted.

The axial turbine according to the second embodiment of the present invention depicted in FIG. 6 includes elements that are substantially identical to those in the axial turbine according to the first embodiment, except for the following. Specifically, in the second embodiment, a cover 6*a* of a bucket 5*a* in an upstream turbine stage has an inclined inner peripheral-side wall. To state the foregoing differently, whereas the cover 6*a* in the first embodiment has a slant angle of zero degrees, the cover 6*a* in the second embodiment has a certain slant angle.

The inner peripheral-side wall of the cover 6*a* having a slant angle allows a difference from the flare angle of an end wall in a nozzle of the diaphragm outer ring 1*b* to be small, so that an even smoother passage surface can be formed.

In FIG. 7, the abscissa represents positions in the steam flow direction and the ordinate represents the rate of change in the passage area. Additionally, the broken line represents characteristics of the known art, the dash-single-dot line represents characteristics in a case without the slant angle, and the solid line represents characteristics in a case with the slant angle.

As depicted in FIG. 7, in the second embodiment, the rate of change in the passage area can be changed continuously and more gradually. Specifically, a steam main stream 9 can more easily follow the chance in the rate of change in the passage area, so that the steam main stream 9 flows downstream without undergoing separation on the inner peripheral-side end wall of the diaphragm outer ring 1*b*.

Moreover, in the second embodiment, the inner peripheral-side wall of the cover 6*a* has a slant angle. This arrangement allows wake that arises from a thickness of the cover 6*a* to be reduced, so that mixing and dissipation of a tip leakage flow 10 and the steam main stream 9 can be accelerated.

In FIG. 8, the abscissa represents the axial velocity with the flow from the upstream to downstream side being defined as positive and the ordinate represents the span of the bucket 5*a*. Additionally, the broken line represents characteristics in a case without the slant angle and the solid line represents characteristics in a case with the slant angle. In the second embodiment, the slant angle of the inner peripheral-side wall of the cover 6*a* enables the mixing and dissipation of the tip leakage flow 10 and the steam main stream 9 to be accelerated. Thus, as depicted in FIG. 8, the axial velocity can be reduced at the tip, so that separation 11 can be prevented even more effectively.

The second embodiment therefore can prevent the separation that would otherwise occur on the inner peripheral-side end wall of the diaphragm outer ring, without affecting the flow pattern in the downstream turbine stage even more effectively.

The above-described axial turbine according to the second embodiment of the present invention can achieve the same effects as those achieved by the first embodiment.

Third Embodiment

Figure 9:
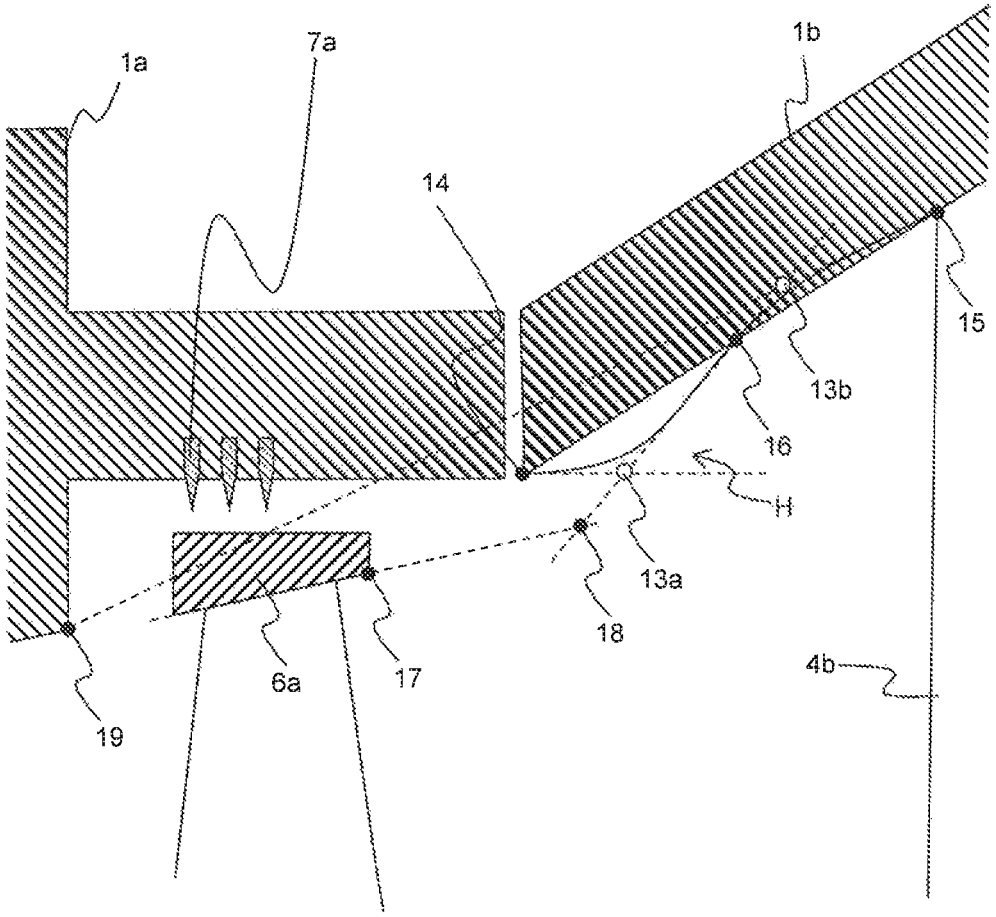
FIG. 9 is a cross-sectional view of part of a meridional cross-section in the vertical direction of a steam turbine as an axial turbine according to a third embodiment of the present invention.

The following describes, with reference to the relevant accompanying drawings, an axial turbine according to a third embodiment of the present invention. FIG. 9 is a cross-sectional view of part of a meridional cross-section in the vertical direction of a steam turbine as the axial turbine according, to the third embodiment of the present invention. In FIG. 9, like reference numerals as those used in FIGS. 1 to 8 denote like or corresponding parts and descriptions for those parts will be omitted.

The axial turbine according to the third embodiment of the present invention depicted in FIG. 9 includes elements that are substantially identical to those in the axial turbine according to the first embodiment, except for the following. Specifically, in the third embodiment, an S-shape in the meridional cross-section on an inner peripheral-side end wall of a diaphragm outer ring 1*b* is formed into a Bezier curve. The following details configurations of the third embodiment with particular emphasis on differences from the first embodiment.

In the third embodiment, the S-shaped end wall is formed of two second-order Bezier curves. This requires two control points to be established. The following describes how to find a first control point.

Reference is made to FIG. 9. A midpoint C 16 between a point A 14 and a point B 15 is obtained. The point A 14 is located most upstream of the meridional cross-section on the inner peripheral-side end wall of the diaphragm outer ring 1*b* and the point. B 15 is located at a tip front edge of a nozzle 4*b*.

A point E 18 is next found. To find the point E 18, note a point D 17 that is located most downstream on an inner peripheral-side wall of a cover 6*a*. The point E 18 is located on a straight line drawn by extending the inner peripheral-side wall of the cover 6*a* from the point D 17 and forms an isosceles triangle with the midpoint C 16 and the point D 17.

Next, an intersection point between a segment connecting the midpoint C 16 and the point E 18 and a straight line extended in the rotational axis direction from the point A 14 is obtained. This intersection point is defined as the first control point 13*a*.

The following describes how to find a second control point. First, note a point F 19 on a diaphragm outer ring 1*a*. The point F 19 is located at an inlet of the seal passage disposed between the diaphragm outer ring is and the cover 6*a*. An intersection point between a segment connecting the point F 19 and the point B 15 and a straight line passing through the midpoint C 16 and the point E 18 is obtained. The intersection point is defined as a second control point 13*b*. A second-order Bezier curve can be formed using the point A 14, the midpoint C 16, and the first control point 13*a*.

Another second-order Bezier curve can be made using the point B 15, the midpoint C 16, and the second control point 13*b*. Specifically, the S-shaped end wall, can be formed using these two second-order Bezier curves. The use of the Bezier curves uniquely defines the S-shape. Although the third embodiment has been exemplary described as using the Bezier curves, the effects achieved by the present invention can still be achieved even through a configuration incorporating a spline curve or another type of curve.

The above-described axial turbine according to the third embodiment of the present invention can achieve the same effects as those achieved by the first embodiment.

Fourth Embodiment

Figure 10:
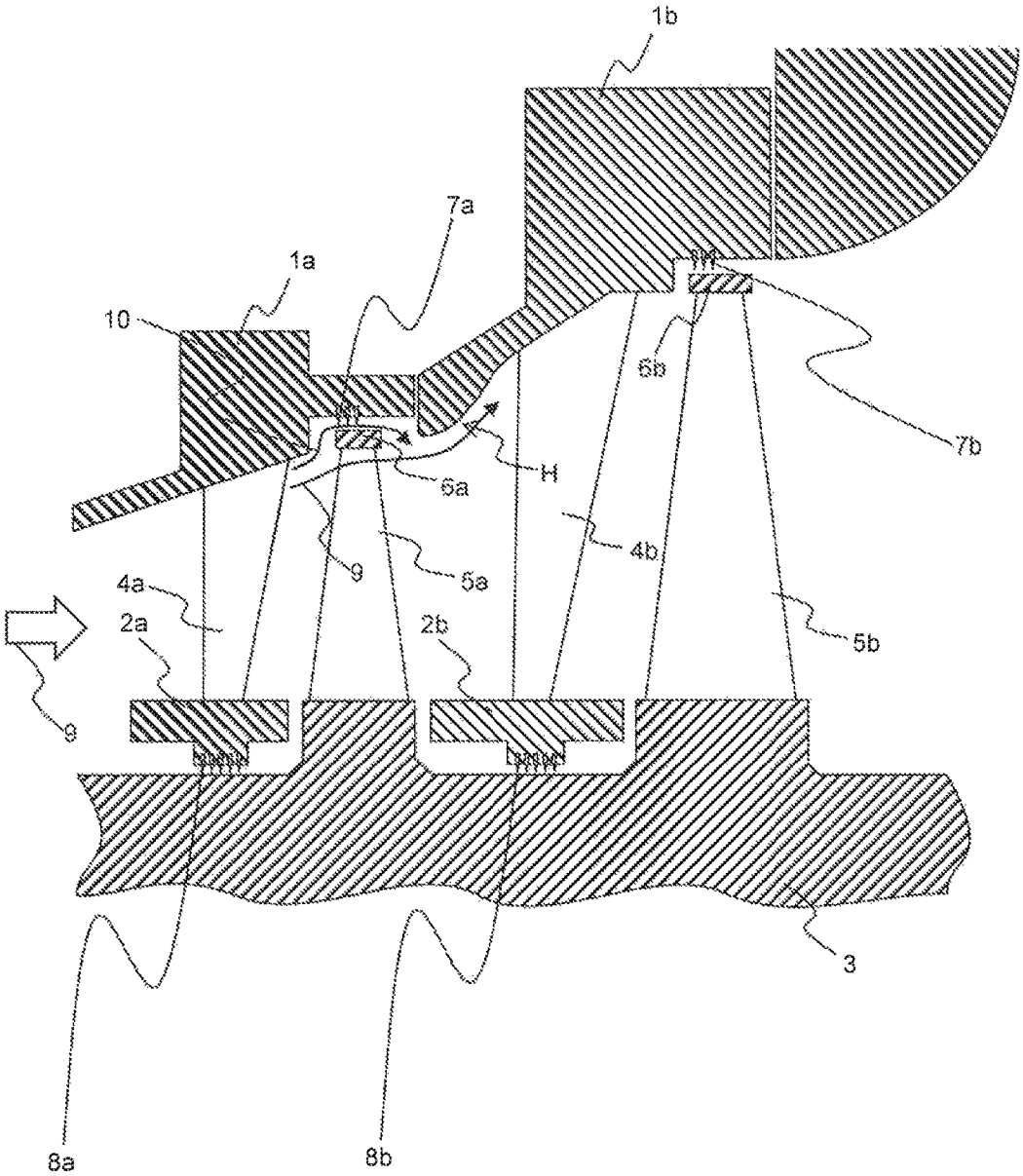
FIG. 10 is a cross-sectional view of part of a meridional cross-section in the vertical direction of a steam turbine as an axial turbine according to a fourth embodiment of the present invention.
Figure 11:
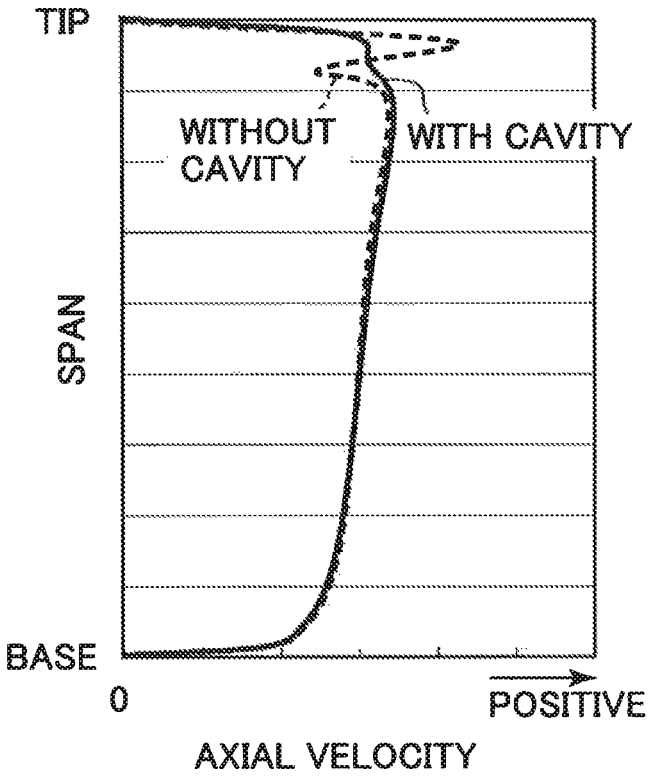
FIG. 11 is a characteristics graph depicting a spanwise axial velocity distribution in a downstream of a bucket in the steam turbine as the axial turbine according to the fourth embodiment of the present invention.

The following describes, with reference to the relevant accompanying drawings, an axial turbine according to a fourth embodiment of the present invention. FIG. 10 is a cross-sectional view of part of a meridional cross-section in the vertical direction of a steam turbine as the axial turbine according to the fourth embodiment of the present invention. FIG. 11 is a characteristics graph depicting a spanwise axial velocity distribution in a downstream of a bucket in the steam turbine as the axial turbine according to the fourth embodiment of the present invention. In FIGS. 10 to 11, like reference numerals as those used in FIGS. 1 to 9 denote like or corresponding parts and descriptions for those parts will be omitted.

The axial turbine according to the fourth embodiment of the present invention depicted in FIG. 10 includes elements that are substantially identical to those in the axial turbine according to the first embodiment, except for the following. Specifically, the fourth embodiment has a cavity provided in a downstream of a bucket in an upstream turbine stage. The following details configurations of the fourth embodiment with particular emphasis on differences from the first embodiment.

Reference is made to FIG. 10. The fourth embodiment is configured such that a minimum radius position of an inner peripheral-side wall of a diaphragm outer ring 1*b* in a downstream turbine stage is located inner side in a radius direction than a radius position of an inner peripheral-side wall of a diaphragm outer ring 1*a*, the radius position being opposed to an outer peripheral-side wall of a cover 6*a* disposed at a distal end of a bucket 5*a* in an upstream turbine stage.

The foregoing configuration allows a continuous passage surface to be formed even when an inner peripheral-side wall of the cover 6*a* is formed into a flat surface. This allows a steam main stream 9 to flow downward without undergoing any separation on en inner peripheral-side end wall of the diaphragm outer ring.

Additionally, the foregoing configuration forms a cavity in a downstream of the cover 6*a*. The cavity causes a tip leakage flow 10 that has flowed as a jet from an outer peripheral-side radial seal tin 7*a* to form a swirl flow inside the cavity.

In FIG. 11, the abscissa represents the axial velocity with the flow from the upstream to downstream side being defined as positive and the ordinate represents the span of the bucket 5*a*. Additionally, the broken line represents characteristics in a case without the cavity and the solid line represents characteristics in a case with the cavity. In the fourth embodiment, having the cavity causes the swirl, flow to be formed to decelerate the tip leakage flow 10. The axial velocity can thereby be reduced. As a result, the separation can be prevented even more effectively.

The fourth embodiment therefore can prevent the separation that would otherwise occur on the inner peripheral-side end wall of the diaphragm outer ring, without affecting the flow pattern in the downstream turbine stage even more effectively.

The above-described axial turbine according to the fourth embodiment of the present invention can achieve the some effects as those achieved by the first embodiment.

It should be noted that the present invention is not limited to the above-described first to fourth embodiments and may include various modifications. The entire detailed configurations of the embodiments described above for ease of understanding of the present invention is not always necessary to embody the present invention.

DESCRIPTIONS OF REFERENCE NUMERALS

1: Diaphragm outer ring
2: Diaphragm inner ring
3: Turbine rotor
4: Nozzle
5: Bucket
6: Cover
7: Outer peripheral-side radial seal fin
8: Inner peripheral-side radial seal fin
9: Steam main stream
10: Leakage flow
11: Separation
12: Flow induced by separation
13: Control point
14: Point A
15: Point B
16: Midpoint C
17: Point D
18: Point
19: Point F

What is claimed is:

1. An axial turbine, comprising:

an upstream turbine stage including:

a plurality of upstream nozzles arrayed in a tangential direction between an upstream diaphragm outer ring and an upstream diaphragm inner ring;

a plurality of upstream buckets disposed on an outer peripheral side of a turbine rotor and arrayed in the tangential direction; and a cover disposed at a distal end of at least one of the upstream buckets and opposed to an inner wall of the upstream diaphragm outer ring across a gap; and a downstream turbine stage including:

a downstream diaphragm outer ring disposed downstream of the upstream turbine stage, the downstream diaphragm outer ring having an inner peripheral-side end wall shaped into a flare;

a plurality of downstream nozzles arrayed in the tangential direction between the downstream diaphragm outer ring and a downstream diaphragm inner ring; and a plurality of downstream buckets disposed on the outer peripheral side of the turbine rotor and arrayed in the tangential direction, the inner peripheral-side end wall of the downstream diaphragm outer ring having a flare angle formed to be greater than a slant angle of an inner peripheral-side wall of the cover, wherein the inner peripheral-side end wall of the downstream diaphragm outer ring has a meridional shape curved into an S-shape that has an inflection point between the at least one of the upstream buckets and a front edge of the downstream nozzle such that a tangent at the inflection point with respect to a steam flow direction has a positive gradient.

2. The axial turbine according to claim 1, wherein a radius position of the inner peripheral-side end wall of the upstream diaphragm outer ring, the radius position being opposed to an outer peripheral-side wall of the cover, is located outer side in a radius direction than a minimum radius position of the inner peripheral-side wall of the downstream diaphragm outer ring.

3. The axial turbine according to claim 1, wherein the meridional shape of the inner peripheral-side end wall of the downstream diaphragm outer ring disposed between the upstream turbine stage and the downstream turbine stage is formed using a Bezier curve.

* * * * *